United States Patent [19]

Barbour

[11] 4,080,734

[45] Mar. 28, 1978

[54] METHOD AND APPARATUS FOR REMOVING A VEHICLE WINDSHIELD

[76] Inventor: Deryle R. Barbour, 632 Martin St., Clarksville, Tenn. 37040

[21] Appl. No.: 726,437

[22] Filed: Sep. 24, 1976

[51] Int. Cl.[2] ..... B25F 3/00; B26B 3/04

[52] U.S. Cl. ..... 30/123; 30/303; 30/277; 7/100; 29/275

[58] Field of Search ..... 29/427, 401 F, 275, 29/235; 30/249, 303, 164.8, 277, 317, 123; 7/14.1 R

[56] References Cited

U.S. PATENT DOCUMENTS

| | | | |
|---|---|---|---|
| 3,448,517 | 6/1969 | Cothery | 30/140 |
| 3,924,327 | 12/1975 | Edwards | 30/277 |

*Primary Examiner*—Milton S. Mehr

*Attorney, Agent, or Firm*—Burns, Doane, Swecker & Mathis

[57] ABSTRACT

A percussion tool having a shank and a pair of generally planar wing portions extending therefrom is provided with a pair of blades which extend from edges of the wing portion. Each wing portion and the corresponding blades are provided with a cutting edge which is L-shaped such that one cutting blade can readily underlie the edge of a windshield during removal. The shank portion is provided with a collar which defines a bit to connect the tool with a pneumatically operated tool holder. The tool includes a nose portion which may be used to break a small slot in the edge of the windshield to receive one wing and blade. The tool is then driven around the circumference of the windshield to sever the adhesive material bonding the windshield to the vehicle and thereby loosen the windshield for easy removal.

9 Claims, 8 Drawing Figures

Fig. 1
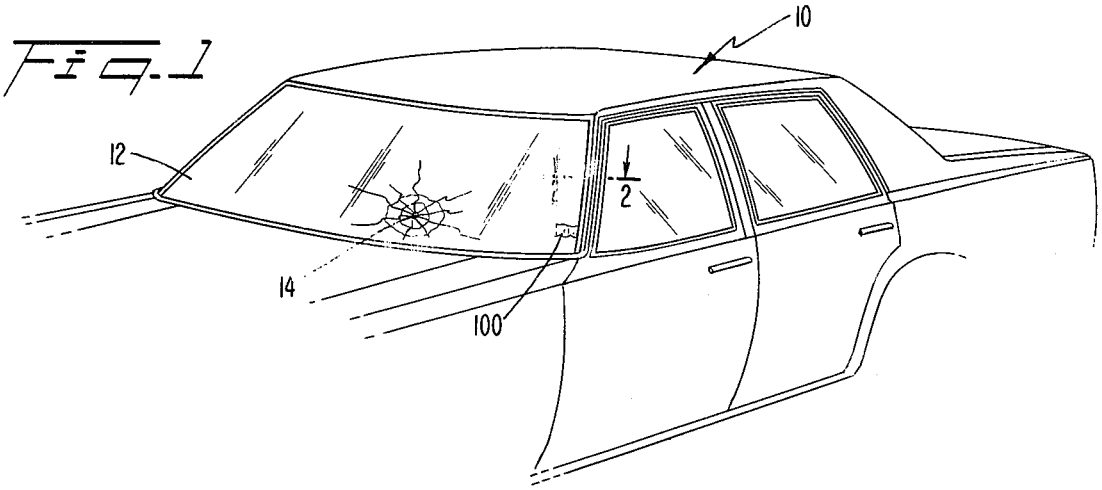
Fig. 2
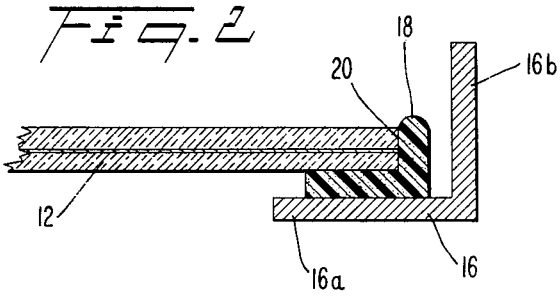
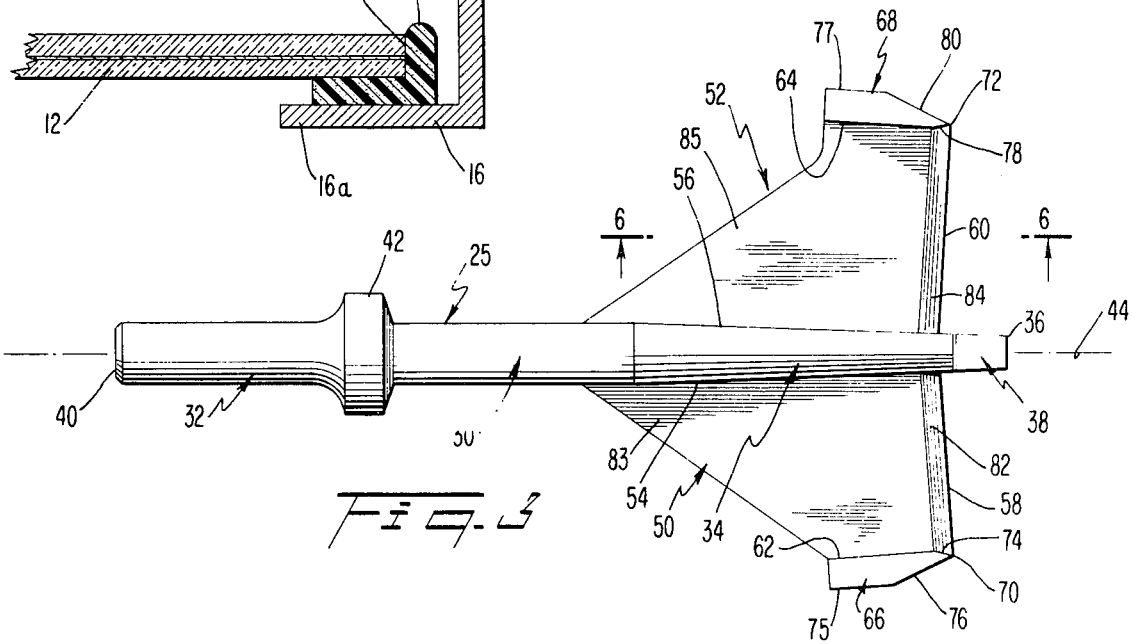
Fig. 3
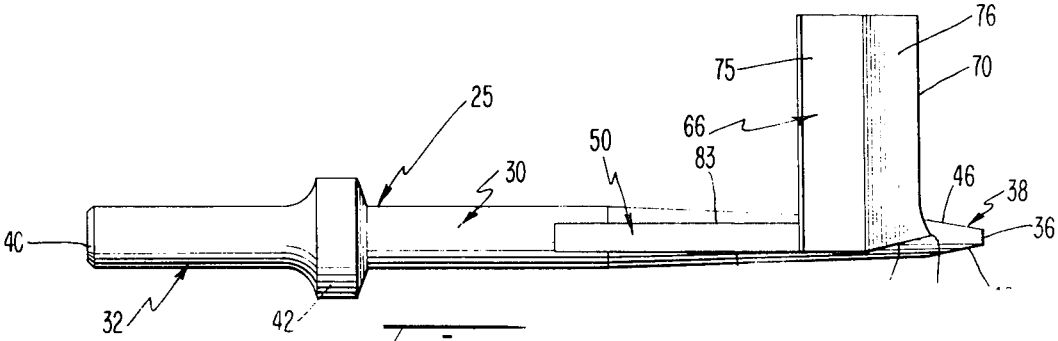
Fig. 4

METHOD AND APPARATUS FOR REMOVING A VEHICLE WINDSHIELD

BACKGROUND OF THE INVENTION

This invention relates generally to the removal of a windshield from a vehicle. More particularly, the invention concerns a percussively driven tool bit and method for using that tool bit in removing a windshield from a vehicle.

In vehicles, such as automobiles, a glass windshield is mounted in a correponding frame, sometimes known as a fence, by lining the frame with an adhesive bonding compound and then applying windshield to the bonding compound. When the bonding compound has dried, the windshield is adhesively and resiliently connected to the frame. The joint between the windshield and the frame is watertight and is typically covered by a cosmetic molding.

Throughout the useful life of a given vehicle, the windshield may become broken or otherwise damaged as a result of accident, flying road debris or one of other numerous causes. In the past, removal of a damaged windshield has required that the adhesive bonding material be cut away or otherwise separated from its relationship to the windshield and the vehicle. To date, no specifically designed tool has been available to efficiently perform this removal operation. Accordingly, windshield removal has been quite timeconsuming and expensive as well. Where the adhesive bonding compound is a hard rubber material frequently used in the industry, removal of a damaged windshield can consume 1 to 2 hours of an experienced mechanic's time thus precluding more productive use of his talents.

When the damaged windshield is one which has replaced the original windshield, the frame is sometimes overfilled as a result of the application of an excessive quantity of adhesive bonding material during installation. Excessive bonding material results in a comparatively wide seal extending from the windshield edge toward the central windshield portion. Accordingly, removal of the damaged windshield is even more difficult where the windshield itself is a replacement.

Thus, it is seen that the need continues to exist for a truly effective method of removing windshields from vehicles, and, in particular, a desperate need exists for a tool which is uniquely adapted to facilitate windshield removal.

OBJECTS AND SUMMARY OF THE INVENTION

It is, therefore, an object of the present invention to provide a novel efficient tool specifically designed to facilitate removal of a damaged windshield from a vehicle.

It is another object of the present invention to provide a novel tool adapted to facilitate removal of an orgiginal as well as a replaced windshield from a vehicle.

Still another object of the present invention is to provide an efficient method for removing a damaged windshield from a vehicle.

A vehicle windshield removal tool, which fulfills the objects set forth above and obviates the difficulties discussed heretofore, preferably includes a shank portion having at least one laterally extending wing portion from which a blade portion extends at a substantially right angle. The wing portion and the blade portion are each provided with a sharpened edge so as to define an L-shaped cutting edge that underlies and extends upwardly past a windshield edge for cutting through conventional adhesive bonding material.

To further reduce the amount of labor involved in actually removing a windshield, the tool is provided with an end which may be mounted in a pneumatic tool holder. In this manner the tool may be pneumatically driven such that, with the blade portion inserted under the windshield edge, the L-shaped cutting edge cuts through the adhesive bonding material and pries the windshield loose from the frame.

Since the pneumatic tool holder may have lateral dimensions exceeding that of the windshield removal tool, the blade portion of the tool is preferably oriented in an angular relationship with respect to a longitudinal axis of the shank portion. Accordingly, the pneumatic tool holder will be positioned above the windshield surface and above the adjacent vehicle surface so as not to damage the finish of the vehicle surface.

So that the tool will be urged into the windshield edge surfaces, the sharpened edges are each defined by a pair of convergent surfaces: one of which has a comparatively short axial length and is adjacent to the windshield edge, the other of which has a comparatively long axial length and is positioned on the outside surface of the tool. The comparatively long surface wedges the tool toward the windshield during the cutting action while the comparatively short surface restrains the sharpened edge from contacting the windshield edge and being dulled thereby.

The removal tool preferably includes a longitudincally extending nose on the shank portion which is adapted to break a small slot in a windshield edge which slot is large enough to accommodate the blade portion of the tool. In this manner the tool may be quicly and accurately position to begin the windshield removal operating.

The tool may be provided with a second wing and a second blade portion which is longer than the first blade portion and which is adapted to cut through the overfilled adhesive bonding of a previously replaced windshield. By orienting both blade portions such that they extend from the plane of the wing portions in the same direction, the traversal direction, clockwise or counterclockwise, in which the operator traverses the windshield periphery will determine which of the two blade portions is used.

BRIEF DESCRIPTION OF THE DRAWINGS

The above as well as many other objects of the present invention will be apparent to those skilled in the art when this specification is read in conjunction with the drawings wherein like reference numerals have been applied to like elements and wherein:

FIG. 1 is a pictorial view of a vehicle having a damaged windshield;

FIG. 2 is a cross sectional view taken along the line 2—2 of FIG. 1;

FIG. 3 is a plan view of a windshield removing tool according to the present invention;

FIG. 4 is a side elevation of the tool of FIG. 3;

DESCRIPTION OF THE PREFERRED EMBODIMENT

Figure 5:
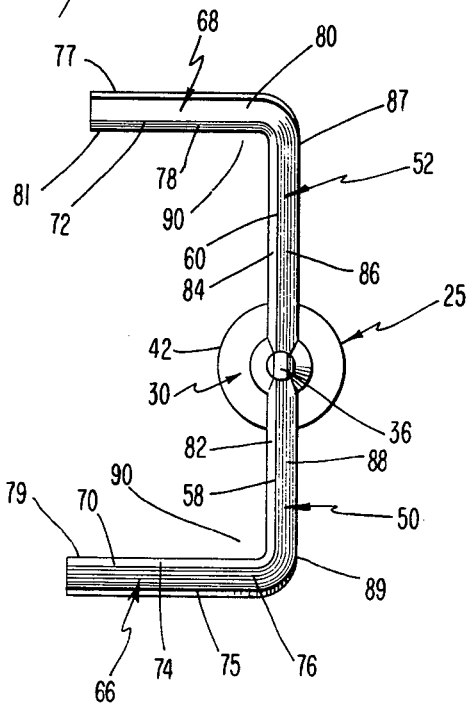
FIG. 5 is an end elevation of the tool of FIG. 3.

Turning now to FIG. 1 a vehicle 10 is depicted having a windshield 12 that has been damaged, as for example when road debris such as a rock impacts the windshield at point 14 and causes a resulting fracture. Turning now to FIG. 2, the windshield 12 is typically fashioned from a suitable conventional automotive safety glass and is mounted in a channel, or fence, 16 which is part of the vehicle and surrounds the opening to be closed by the windshield. The channel 16 typically has one arm 16*a* which underlies and is substantially parallel to a peripheral edge portion 20 of the windshield 12. A second arm 16*b* of the channel 16 extends at an angle relative to the first arm 16*a* and may be substantially perpendicular, as illustrated, or may be inclined at any other suitable angle, as desired.

To mount the windshield 12 in the frame 16 with a secure, weathertight joint, suitable conventional adhesive bonding material 18 is placed along the first arm 16*a* of the channel 16 around the entire periphery of the opening. Thereafter, the edge portion 20 of the windshield 12 is pressed into the adhesive bonding compound 18 which tends to extrude along the first arm 16*a* and around the edge portion 20. In the foregoing manner the windshield 12 is secured to the vehicle along the entire peripheral portion 20 thereof.

In order to remove a damaged windshield 12 from the mounting channel 16, a windshield removal tool 25 (see FIG. 3) has been devised which eases the heretofore difficult task and greatly reduces the time required for windshield removal. The tool 25 may be fashioned from tool steel or any other suitable material and includes a shank portion 30 having a generally cylindrical surface portion 32 and a generally frustoconical surface portion 34.

The frustoconical surface portion 34 terminates at a first end 36 which includes a longitudinally extending projection, or nose, 38. The cylindrical portion 32 terminates at a second end 40 of the shank portion 30. The second end 40 is designed to receive percussive blows and may be provided with a radially outwardly extending circumferential collar 42. The collar 42 and the generally cylindrical portion 32 cooperate to define a bit whereby the tool 25 can be operatively connected with a suitable conventional pneumatically driven impact tool holder (not shown).

The shank portion 30 is essentially rotationally symmetric about a longitudinal extending axis 44 such that the cylindrical portion 32 and the frustoconical portion 34 are coaxially aligned. In this manner, percussive blows applied to the second end 40 have virtually no tendency to pend the shank portion 30. If desired, the projecting nose 38 may be provided with a pair of slightly convergent surfaces 46, 48 which converge toward the first end 36 and the shank portion 30 to concentrate the force of percussive blows applied to the second end 40 when the nose abuts a surface.

Extending to each side of the shank portion 30 is a generally trapezoidally shaped wing portion 50, 52. Each wing portion 50, 52 is suitably connected to the shank portion 30 in force transmitting relationship such as by seam welding along a corresponding long long edge 56, 56. The long edges 54, 56 are preferably attached to the frustoconical surface portion 34 so that corresponding short edges 62, 64 are each angularly inclined relative to the longitudinal axis 44. Moreover, by attaching the long edges 54, 56, to the shank portion 30, the trapezoidal configuration of each wing portion 50, 52 provides a laterally extending brace for a corresponding sharpened edge 58, 60. It is pertinent to note that either short edge 62, 64 may be convergently inclined relative to the axis 44 so as to define an angle with the axis which exceeds the cone semi angle of the frustoconical surface portion 34.

The sharpened cutting edge 58, 60 of each wing portion 50, 52 extends generally perpendicularly from the frustoconical surface portion 34 of the shank portion 30. The wing portions 50, 52 are each secured to the shank portion 30 between the first end 36 and the second end 40 such that the sharpened edges 58, 60 do not extend axially as far as the nose 38. In this manner the nose 38 can be used to break a windshield without the wing portions engaging the windshield. Each of the wing portions 50, 52 is essentially coplanar with the other wing portion 50, 52 as well as coplanar with the longitudinal axis 44 of the shank portion 30. In this manner the sharpened edges 58, 60 each extend in essentially diametrically opposite directions. Accordingly, when one sharpened edge is in use the other sharpened edge is positioned to provide minimal interference.

Extending upwardly out of the plane of the wing portions 50, 52 are a pair of blade portions 66, 68. By positioning both blade portions 66, 68 to extend from the same side of the plane, one blade portion 66 will always be associated with clockwise traversal of a windshield perimeter and the other blade portion 68 will always be associated with counterclockwise traversal of a windshield perimeter.

Each blade portion 66, 68 is connected in force transmitting relationship to the corresponding wing portion 50, 52 along the short edge 62, 64 thereof. With each short edge 62, 64 being inclined relative to the longitudinal axis 44, the plane of the corresponding blade portion 66, 68 is also angularly inclined relative to the axis 44. Thus, when the tool 25 is mounted in a tool holder and one blade portion is essentially parallel to an edge of a windshield, the tool holder is inclined away from the windshield and the surrounding vehicle surface. Turning now to FIG. 5 it will be observed that the blade portion 66 has an upstanding length which exceeds the upstanding length of the other blade portion 68. By selecting the lengths of the blade portions 66, 68 at different values the longer blade portion 66 may be used to cut through the comparatively wide adhesive bonding material associated with a windshield which has already replaced the original windshield supplied with the vehicle.

Each blade portion 66, 68 in FIG. 4 is provided with a corresponding cutting edge 70, 72 which is slightly offset, axially to the rear of, the laterally extending cutting edge 58, 60 of the corresponding wing portion 50, 52. Returning now to FIG. 5 it will be seen that the cutting edges 58, 70 and the cutting edges 60, 72 each cooperate to define a substantially L-shaped cutting edge on opposite sides of the shank portion 30.

Each cutting edge 70, 72 (see FIG. 3) of each blade portion 66, 68 is fashioned from a pair of convergent generally planar surfaces 74, 76, 78, 80. Each surface 76, 80 of the respective blade portions 66, 68 (see FIG. 4) has a comparatively long length measured in a generally axial direction perpendicular to the corresponding cutting edge 70, 72 and is positioned at an edge of a corresponding outside surface 75, 77 of the corresponding blade portion 66, 68. In contrast each of the other convergent surfaces 74, 78 (see FIG. 6) has a comparatively short length measured in a generally axial direction perpendicular to the corresponding cutting edge 70, 72 and is positioned at an edge of a corresponding inside surface 79, 81 of the corresponding blade portion 66, 68.

Figure 6:
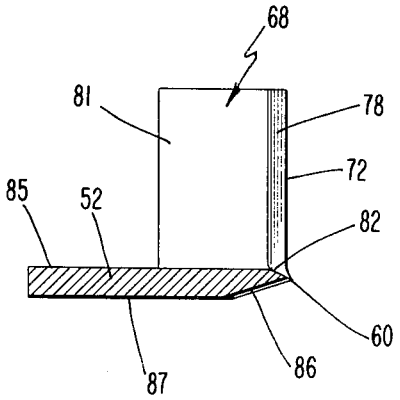
FIG. 6 is a cross sectional view taken along the line 6—6 of FIG. 3.

Similarly, each sharpened cutting edge 58, 60 of each wing portion 50, 52 is fashioned from a pair of generally convergent surfaces 82, 84, 86, 88 (see FIGS. 3, 4 and 6). Each convergent surface 82, 84 (FIG. 3) has a comparatively short length measured in a generally axial direction perpendicular to the corresponding cutting edge 58, 60 and is positioned at an edge of a corresponding inside surface 83, 85 of the corresponding wing portion 50, 52. In contrast, each of the other convergent surfaces 86, 88 (see FIGS. 4 and 6) has a comparatively long axial length measured in a generally axial direction perpendicular to the corresponding cutting edge 58, 60 and is positioned at an edge of a corresponding outside surface 87, 89 of the corresponding wing portion 52, 50.

By placing the longer convergent surface 76, 80, 86, 88 on the outside of the corresponding cutting edge, the tool 25 will be urged toward the edge of the windshield that, during use, typically occupies a position 90 (see FIG. 5) lying within the acute angle defined by one of the wing portion inside surfaces 83, 85 and the corresponding blade portion inside surface 79, 81. In addition, the corresponding comparatively short inside surfaces 74, 82, 84, 78 which cooperate to define the cutting edge, aid in spacing the cutting edge from the windshield edge. In this fashion, the short inside surfaces deep the associated cutting edge from being dulled by engagement with the windshield glass.

Each pair of convergent surfaces 74–76, 78–80, 82–88, 84–86 (see FIG. 3) forms an acute angle at the corresponding cutting edge 70, 72, 58, 60. The angle may be selected as desired but conveniently is selected so that the plane of each convergent surface 74, 76, 78, 80, 82, 84, 88, 88 makes substantially the same angle with the plane of the corresponding surface 79, 75, 81, 77, 83, 85, 87, 89. Thus, each convergent surface of a cutting edge is noncoplanar with the corresponding surface of the wing portion or blade portion.

Preferably, the blade portion 66, 68 (see FIG. 3) and the wing portions 50, 52 may be fashioned from 3/16 inch thick sheet stock. The shank portion 30 may be fashioned from suitable bar stock. The desired overall length between the first end 36 and the second end 40 is about 6 inches with overall width between outside surfaces 75, 77 of the blade portions 66, 68 being about 3 inches. Respective lengths of the blade portions 66, 68 may be 1½ inches and 1⅜ inches. The length of the short convergent surfaces 74, 78, 82, 84 may be between ⅛ to 3/16 inch whereas the length of the long convergent surfaces 76, 80, 86, 88 may be between 5/16 to 7/16 inch. Good proportions for the wing portions 50, 52 are a length adjacent to the shank portion 30 of 2¼ inches, and width along the cutting edge 58, 60 of 1 inch 1 3/16 inch, respectively.

Returning now to FIG. 1, the operation of the windshield removal tool 25 will now be described in connection with the removal of the damaged windshield 12 from the vehicle 10. Preferably, the tool 25 is mounted in a pneumatically driven tool holder. Alternatively, the send end 40 of the tool can be driven by percussive blows from a hammer. The nose portion 38 (see FIG. 3) of the tool 25 is then placed in abutment with a portion of the windshield surface. Percussive blows are applied to the second end 40 in order to break a small slot 100 (see FIG. 1) in a peripheral portion of the damaged windshield 12. The particular location of the slot 11 is not significant and may be selected as a matter of convenience after any decorative molding covering the joint between the windshield 12 and the vehicle 10 has been removed. The slot 100 is fashioned so as to have dimensions which exceed the width and length of one blade portion 66, 68 that has previously been selected for use.

Figure 7:
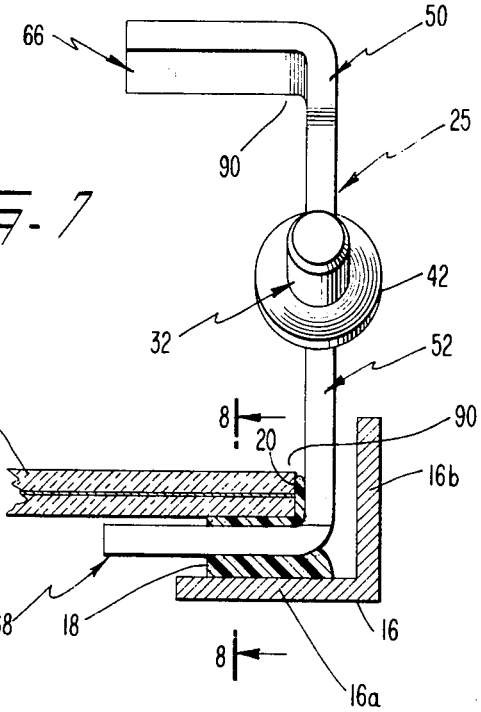
FIG. 7 is a view similar to FIG. 2 illustrating the use of the tool.
Figure 8:
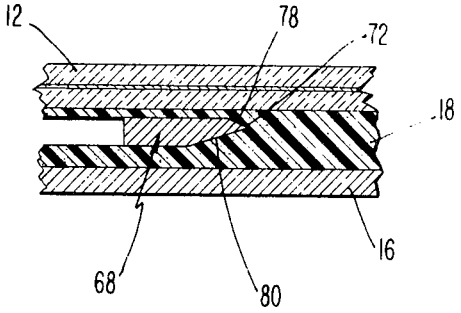
FIG. 8 is a view taken along the line 8—8 of FIG. 7.

After the slot 100 has been formed in the windshield 12, the tool 25 is inserted into the slot such that the selected blade portion 66, 68 enters the slot with the corresponding cutting edge engaging the adhesive bonding material 18 (see FIG. 7). As the tool 25 is driven, the tool 25 severs the adhesive bonding material 18 while also prying the windshield 12 loose from the frame 16. It will be noted (see FIG. 3) that the plane of the blade portion 68 is inclined with respect to the longitudinal axis 44 of the shank portion 30 of the tool 25. As a result of the inclination, the pneumatically driven tool holder is elevated above the surface of the vehicle so as to minimize the potential for damage to the vehicle finish. As the tool 25 is percussively driven, it advances through the adhesive bonding material 18 such that the edge portion 20 (see FIG. 7) of the windshield 12 is positioned in the corner 90 of the acute angle defined by the connection between the wing portion 52 and the blade portion 68. The cutting edges of both the blade portion 58 and the wing portion 52 advance through the adhesive bonding material 18 (see FIG. 8) and free the windshield 12 from the frame 16.

By using a percussively driven tool 25 designed in accordance with the present invention, it has been found possible to remove a damaged windshield 12 (FIG. 1) from a vehicle in 5 to 10 minutes as compared with the 1 to 2 hours frequently associated with prior methods of removing a damaged windshield. Thus, the present invention greatly increases the speed with which a damaged windshield can be removed for replacement and, therefore, reduces the expenditure of time and labor necessary to change a windshield. With these factors in mind, economic significance of the present invention is apparent; it increases the number of windshields that a shop may replace within any given period of time and, therefore, substantially increases the dollar volume of work which can be performed by the shop.

By providing the tool with two differently sized blade portions the long blade portion may be used for previously replaced windshields where it is necessary to cut through a comparatively wide layer of adhesive bonding material fixing the windshield to the vehicle. In addition, by providing the two blade portions such that they both extend to the same side from the plane defined by each of the two wing portions 50, 52, the tool operator is provided with a convenient and positive method for determining which of the two blades he is using. More particularly, with the blades on the same side of the wing portions when the periphery of the windshield 12 is traversed in a clockwise direction one of the two blade portions will necessarily be used. Alternatively, when the windshield is traversed in a counterclockwise direction, the other of the two blade portions will necessarily be used. In this manner, the particular blade portion to be used may be determined merely by selecting the direction in which the windshield periphery is to be traversed. This simple method of determining the direction of windshield traversal and thereby selecting the necessary blade length is particularly convenient in a tool to be used by workers that prefer simple tools.

It should now be apparent that a novel tool has been provided in accordance with the present invention which facilitates the rapid and efficient removal of a damaged windshield from a vehicle.

In addition, the tool has the advantage of being designed to be percussively driven and to present little change to the vehicle surface finish.

The novel tool may be driven by a pneumatically driven device or by percussive blows from an instrument such as a hammer.

Moreover, to facilitate the initial insertion of the tool, the tool is provided with a nose adapted to break a slot in the windshield.

It should now be apparent that there has been provided in accordance with the present invention a novel windshield removal tool and method of removing windshields. Moreover, it will be apparent to those skilled in the art that numerous modifications, variations, substitutions and equivalents for the features of the apparatus and steps of the method may be made without departing from the spirit and scope of the invention. Accordingly, it is expressly intended that all such modifications, variations, substitutions and equivalents for the features and steps which fall within the spirit and scope of the invention, as defined in the appended claims, be embraced thereby.

I claim:

1. A tool for rapidly removing a damaged windshield from a vehicle comprising:

a shank portion having a first end, a second end, for receiving percussive blows, a longitudinal axis; and including a projection at the first end;

a first wing portion connected to the shank portion between the first end and the second end so as to be substantially coplanar with the longitudinal axis, being connected to the shank portion so that the projection extends longitudinally beyond the first wing portion, having one edge forming an angle with the longitudinal axis and having a sharpened second edge extending between the shank portion and the one edge to provide a cutting edge; and a first blade portion connected to the one edge of the first wing portion, oriented so as to be substantially perpendicular to the first wing portion and having a sharpened cutting edge which cooperates with the second edge of the first wing portion to define an L-shaped cutting edge.

2. The tool of claim 1 further including:

a second wing portion connected to the shank portion between the first end and the second end so as to be substantially coplanar with the longitudinal axis, being connected to the shank portion so that the projection extends longitudinally beyond the second wing portion, having one edge forming a second angle with the longitudinal axis and having a sharpened second edge extending between the shank portion and the one edge; and a second blade portion connected to the one edge of the second wing portion, oriented so as to be substantially perpendicular to the first wing portion and having a sharpened cutting edge which cooperates with the second edge of the second wing portion to define a second L-shaped cutting edge.

3. The tool of claim 2 wherein the first wing portion and the second wing portion are substantially coplanar so that the second L-shaped cutting edge is essentially diametrically opposed to the first L-shaped cutting edge during use.

4. The tool of claim 3 wherein the first blade portion and the second blade portion extend in the same direction from the plane of the first wing portion and the second wing portion.

5. The tool of claim 4 wherein each of the first L-shaped cutting edge and the second L-shaped cutting edge is defined by a pair of convergent surfaces noncoplanar with the corresponding wing portion, one convergent surface being position on the inside surfaces of the tool and having a first length and the second convergent surface being positioned on the outside surface of the tool and having a second length exceeding the first length so that the tool is pushed toward a windshield edge by the long second surface and is restrained from engaging the windshield edge by the first surface.

6. The tool of claim 4 wherein the second blade portion extends further from the plane than does the first blade portion to provide a longer cutting edge for severing windshield adhesive.

7. The tool of claim 1 further including a circumferential protrusion positioned on the shank portion between the second end and the first wing portion so that a bit is defined for mounting the second end in a pneumatically driven tool holder.

8. The tool of claim 1 wherein the L-shaped cutting edge is defined by a pair of convergent surfaces noncoplanar with the first wing portion, one convergent surface being positioned on the inside surface of the tool and having a first length and the second convergent surface being positioned on the outside surface of the tool and having a second length exceeding the first length so that the tool is pushed toward the windshield edge by the long second surface and is restrained from engaging the windshield edge by the first surface.

9. A tool for rapidly removing a damaged windshield resiliently bonded to a frame of a vehicle, comprising:

a shank portion having a frustoconical section terminating at a first end, a cylindrical section terminating at a second end, a nose at the first end, a longitudinal axis, and a radially outwardly extending collar which cooperates with the cylindrical section to provide a bit whereby the second end may be mounted in a pneumatically driven tool holder;

a pair of wing portions lying essentially in one common plane, each wing portion being welded to the frustoconical section of the shank portion such that the nose extends therebeyond, having a substantially trapezoidal shape with a cutting edge extending generally perpendicularly from the shank portion and a short edge substantially parallel to the surface of the frustoconical section;

a pair of blade portions extending from the same side of the plane, each blade portion connected to a corresponding short edge of a corresponding wing portion and having a cutting edge facing the first end, one blade portion cutting edge having a length which exceeds the length of the other blade portion cutting edge; and each cutting edge of the wing portions and the blade portions being defined by a pair of convergent surfaces, one convergent surface being short and the other convergent surface being long so that the cutting edge is urged toward a windshield edge by the long convergent surface and restrained from contacting the windshield edge by the short surface.

* * * * *